US011515626B2

(12) United States Patent
Cran

(10) Patent No.: US 11,515,626 B2
(45) Date of Patent: Nov. 29, 2022

(54) PLUG-IN ANTENNA

(71) Applicant: Make Great Sales Limited, Hong Kong (HK)

(72) Inventor: Bruce Cran, Richmond (CA)

(73) Assignee: MAKE GREAT SALES LIMITED, Hong Kong (HK)

( * ) Notice: Subject to any disclaimer, the term of this patent is extended or adjusted under 35 U.S.C. 154(b) by 42 days.

(21) Appl. No.: 17/056,943

(22) PCT Filed: May 22, 2019

(86) PCT No.: PCT/CA2019/000075
§ 371 (c)(1),
(2) Date: Nov. 19, 2020

(87) PCT Pub. No.: WO2019/222831
PCT Pub. Date: Nov. 28, 2019

(65) Prior Publication Data

US 2021/0143540 A1 May 13, 2021

Related U.S. Application Data

(60) Provisional application No. 62/675,016, filed on May 22, 2018.

(51) Int. Cl.
*H01Q 1/46* (2006.01)
*H01B 11/18* (2006.01)
(Continued)

(52) U.S. Cl.
CPC ..... *H01Q 1/46* (2013.01); *H01B 11/1808* (2013.01); *H01Q 1/50* (2013.01); *H01R 31/065* (2013.01)

(58) Field of Classification Search
CPC .. H01Q 1/44; H01Q 1/46; H01Q 1/50; H01Q 7/06; H01Q 7/08; H01F 19/04;
(Continued)

(56) References Cited

U.S. PATENT DOCUMENTS 2,709,219 A * 5/1955 Schmidt, Jr. ..... H01Q 9/16 455/292
2,860,312 A * 11/1958 Krepps, Jr. ..... H01F 19/04 333/32

(Continued)

FOREIGN PATENT DOCUMENTS

EP 2077601 A1 * 7/2009 ..... H01Q 1/46
JP 2005136907 A * 5/2005
JP 4105078 B2 6/2008

OTHER PUBLICATIONS

International Search Report, PCT/CA2019/000075, dated Jul. 25, 2019, pp. 1-3.

(Continued)

*Primary Examiner* — Dameon E Levi
*Assistant Examiner* — Leah Rosenberg
(74) *Attorney, Agent, or Firm* — Cochran Freund & Young LLC; William P. O'Meara; William W. Cochran

(57) ABSTRACT

A plug-in device is provided for adapting a building's electrical wiring system as an antenna for receiving radio or over-the air television signals. The device has a plug for insertion into an electrical receptacle in the building, a coaxial connector for providing the communication signal captured by the antenna to a signal receiver, and a plurality of conducting wires extending from the plug to the coaxial connector. The conducting wires comprise first and second wires, and a third wire in electrical contact with the coaxial connector. The first and second wires are electrically insulated from each other and from the third wire to prevent passage of alternating current (AC) power to the signal receiver. The wires are wound to inductively transfer the communication signal captured by the antenna to the third wire for output to the signal receiver via the coaxial connector.

17 Claims, 7 Drawing Sheets

(51) Int. Cl.
*H01Q 1/50* (2006.01)
*H01R 31/06* (2006.01)

(58) Field of Classification Search
CPC ..... H01F 2002/005; H01F 2005/027; H01R 31/065; H01R 2201/02; H01R 31/06; H04B 3/54; H04B 3/56; H04B 11/18; H04B 2203/5483; H04B 2203/5487; H03H 7/42; H01P 3/06; H01P 5/103; H01P 7/04; H01P 1/069; H01P 1/266; H01P 1/2053; H01P 5/085
See application file for complete search history.

(56) References Cited

U.S. PATENT DOCUMENTS 5,327,230 A * 7/1994 Dockery ..... H04N 7/108 348/E7.051
5,696,861 A * 12/1997 Schimmeyer ..... G02B 6/3817 385/75
5,832,364 A * 11/1998 Gustafson ..... H01Q 1/46 455/14
2010/0194197 A1* 8/2010 Lee ..... H02J 1/08 307/31
2010/0248671 A1 9/2010 Yoshino et al.
2014/0191909 A1* 7/2014 Tinaphong ..... H01Q 1/2275 343/702

OTHER PUBLICATIONS

Written Opinion of the International Searching Authority, PCT/CA2019/000075, dated Jul. 25, 2019, pp. 1-4.

* cited by examiner

PLUG-IN ANTENNA

TECHNICAL FIELD

The present disclosure relates generally to antennas, and more particularly to an antenna module for receiving communication signals using the electrical wiring of a building's electrical system.

RELATED APPLICATIONS

This application claims priority from U.S. Provisional Patent Application No. 62/675,016 filed on May 22, 2018 entitled "Plug-In Antenna". This application claims the benefit under 35 USC § 120 of U.S. application No. 62/675,016 filed May 22, 2018 entitled "Plug-In Antenna", which is incorporated herein by reference in its entirety. This application also claims priority from application PCT/CA2019/000075, entitled "Plug-In Antenna," filed May 22, 2019, which is incorporated herein by reference in its entirety, and which claims priority from U.S. Provisional Patent Application Ser. No. 62/675,016, filed May 22, 2018, entitled "Plug-In Antenna," which is incorporated by reference above.

BACKGROUND

With the introduction of high-definition terrestrial radio and television broadcasts, consumers are able to listen to high-fidelity audio and watch high-definition television programming without the need to pay for a music subscription or television subscription from a cable, satellite or IP (Internet Protocol) television provider. A radio or television antenna is generally needed to receive over-the-air radio or television broadcasts, especially for radio listeners or television viewers located at a distance from a broadcast tower.

Various types of antennas are available for receiving radio and television broadcasts, including, for example, indoor "rabbit ear" antennas and more elaborate outdoor antennas that are mountable on the roof or other external part of a building. An indoor antenna may not provide optimal reception because its receiving cross section is generally small, which results in a lowered antenna efficiency. Furthermore, the electromagnetic waves corresponding to radio and television signals may attenuate as they penetrate through various building materials such as concrete. Such attenuation further degrades signal quality. Outdoor antennas may address some of these identified deficiencies, although they are generally more difficult to install and maintain. Additionally, it may not be possible to install an outdoor antenna given its size and building restrictions (e.g. for residents of apartments). Therefore additional options to improve television reception are needed.

SUMMARY OF THE DISCLOSURE

In general, the present specification describes apparatus and methods for receiving communication signals using the electrical wiring of a building's electrical system and providing the communication signals to a signal receiver.

One aspect provides a module for adapting at least a portion of a building's electrical wiring system as an antenna for receiving a radio frequency signal comprising a communication signal. The communication signal may be an over-the-air radio or television signal. The module comprises a plug portion for insertion into an electrical receptacle in the building to connect the apparatus to the building's electrical wiring system. The module comprises a coaxial connection portion with a coaxial connector for providing the communication signal captured by the antenna to a signal receiver.

The module also comprises a body portion between the plug portion and the coaxial connector portion. The body portion incorporates a plurality of conducting wires extending from the plug portion to the coaxial connector. The conducting wires comprise first and second conducting wires, and a third conducting wire in electrical contact with or close proximity to the coaxial connector. The first and second conducting wires are electrically insulated from each other and from the third conducting wire to prevent transfer of alternating current (AC) from the building's electrical system to each other and to the third wire. The first and second conducting wires may be electrically insulated from each other and from the third conducting wire by sheathing the first and second conducting wires in an insulating material such as rubber or plastic. The first and second conducting wires are wound around the third conducting wire to inductively transfer the communication signal captured by the antenna to the third conducting wire for output to the signal receiver via the coaxial connector. The first and second conducting wires may form a helical coil around the third conducting wire.

In some embodiments of the module, the plug portion comprises a two-pronged connector comprising first and second electrical connectors for connecting to the live and neutral AC wires respectively of the building's electrical system. The first and second conducting wires of the module are connected to the live and neutral AC wires via the first and second electrical connectors respectively. The third conducting wire may serve as a core for the winding. In particular embodiments, the core comprises a ferromagnetic material to increase the inductance of the winding.

In other embodiments of the module, the plug portion comprises a three-pronged connector comprising a ground pin for connecting to a dedicated ground pathway for the building's electrical system. The plug portion also comprises first and second electrical connectors for connecting to the live and neutral AC wires respectively of the building's electrical system. The first and second conducting wires of the module are connected to the live and neutral AC wires via the first and second electrical connectors respectively. The third conducting wire connects to the ground pin. The third conducting wire may serve as a core for the winding. In particular embodiments, the core comprises a ferromagnetic material to increase the inductance of the winding.

In some embodiments, the first and second conducting wires are left unterminated at the coaxial connector portion. In other embodiments, the coaxial connector portion comprises a second electrical receptacle for receiving an electrical plug of an electrical device or appliance, and the first and second conducting wires are connected to the second electrical receptacle.

Another aspect provides a plug-in device for delivering a radio or television signal to a receiver. The device comprises a rear portion incorporating a plug for insertion into a corresponding electrical receptacle in a building to connect the plug-in device to the building's electrical wiring system. The device comprises a front portion comprising a coaxial connector. The device also comprises a winding extending between the plug and the coaxial connector, comprising a plurality of conducting wires wrapped around a core. First and second conducting wires are sheathed in electrically insulating material and connected to the live and neutral AC wires respectively of the building's electrical system, and a third conducting wire is in contact with the coaxial connector. The first and second conducting wires inductively transfer a radio frequency signal captured by the building's electrical wiring system to the third conducting wire for output to the receiver via the coaxial connector.

Another aspect provides a method for adapting at least a portion of a building's electrical wiring system as an antenna for receiving a radio frequency signal comprising a communication signal. The method comprises providing a plug for insertion into a corresponding electrical receptacle in a building to connect to the building's electrical wiring system; providing a coaxial connector; and providing first, second and third conducting wires extending between the plug and the coaxial connector. The first and second conducting wires are wound around the third conducting wire and are sheathed in electrically insulating material to prevent passage of AC to each other and to the third conducting wire. The method comprises connecting the first and second conducting wires to the live and neutral AC wires respectively of the building's electrical system via the connector prongs of the plug, and connecting the third conducting wire with the coaxial connector, so that the first and second conducting wires inductively transfer the radio frequency signal captured by the building's electrical wiring system to the third conducting wire for output to a receiver via the coaxial connector. In embodiments where the plug comprises a ground pin, the method comprises connecting the third conducting wire to the ground pin.

Another aspect provides an apparatus for adapting at least a portion of a building's electrical wiring system as an antenna for receiving a radio frequency signal comprising a communication signal. The apparatus comprises a plug portion for insertion into an electrical receptacle in the building to connect the apparatus to the building's electrical wiring system; a coaxial connection portion comprising a coaxial connector for providing the communication signal captured by the antenna to a signal receiver; and a body portion between the plug portion and the coaxial connector portion, the body portion comprising at least one conducting wire extending from the plug portion to the coaxial connector, the at least one conducting wire comprising a first conductor in electrical contact to the coaxial connector and wherein the communication signal captured by the antenna is carried by the first conductor for output to the signal receiver via the coaxial connector.

In some embodiments, the plug portion comprises a three-pronged connector comprising a conductive ground pin for connecting to a dedicated ground pathway for the building's electrical system, and insulating first and second prongs for insertion into sockets that provide access to live and neutral AC wires of the building's electrical system. The first conductor of the apparatus connects to the ground pin.

Additional aspects of the present invention will be apparent in view of the description which follows.

BRIEF DESCRIPTION OF THE DRAWINGS

Features and advantages of the embodiments of the present invention will become apparent from the following detailed description, taken with reference to the appended drawings in which.

DETAILED DESCRIPTION

The description which follows, and the embodiments described therein, are provided by way of illustration of examples of particular embodiments of the principles of the present invention. These examples are provided for the purposes of explanation, and not limitation, of those principles and of the invention.

Antennas can be used to receive electromagnetic waves corresponding to communication signals such as radio and television signals. Such antennas generally comprise an array of conductors that are electrically connected to a receiver. The quality of the received signal depends on various antenna parameters such as directionality, effective area and gain. For example a small indoor "rabbit ear" antenna may be suitable to receive a television signal if the receiver is sufficiently close to a broadcast tower. However, the usefulness of the indoor antenna degrades as the receiver's distance to the broadcast tower is increased because the antenna's efficiency is generally low.

Instead of using conventional antennas, the present invention is directed to adapting or converting a portion of or the entire electrical wiring of a building's electrical system to function as an antenna. Specifically, one or both of the current-carrying "live" wires as well as grounding wires via electrical receptacles installed throughout a building is used to improve signal reception. Each segment of wiring can be regarded as an element of an array of conductors of an antenna. Accordingly, the extensiveness of the wiring can be exploited to improve reception of various communication signals. However, one of the challenges with respect to such systems is the possibility for transfer of potentially harmful electrical current from the electrical wiring to a signal receiver such as a television. Described in the present disclosure is a plug-in antenna module that can be used as an interface between a signal receiver (such as a television or radio receiver) and the electrical wiring within a building so that the wiring can be used as an antenna by the receiver. The module is operable to transfer a received communication signal to the receiver while preventing transfer of potentially harmful electrical current to the receiver's input port. The communication signal may comprise an over-the-air television signal or radio signal. It may in some cases comprise an emergency broadcast signal.

Figure 1C:
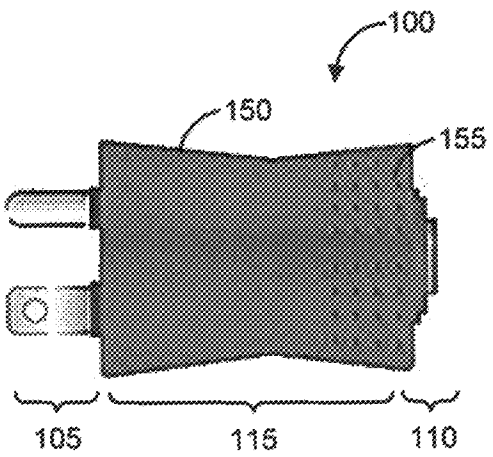
FIGS. 1A to 1C (collectively, FIG. 1) are rear, front and side perspective views of a plug-in antenna module according to one embodiment of the invention.
Figure 1B:
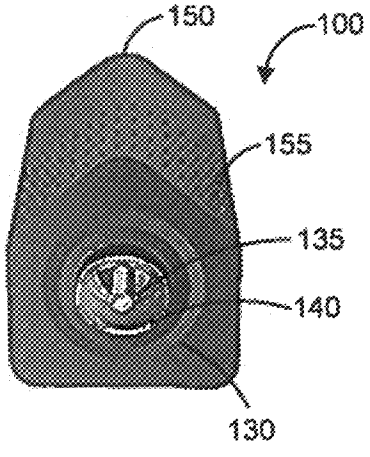
Figure 1A:
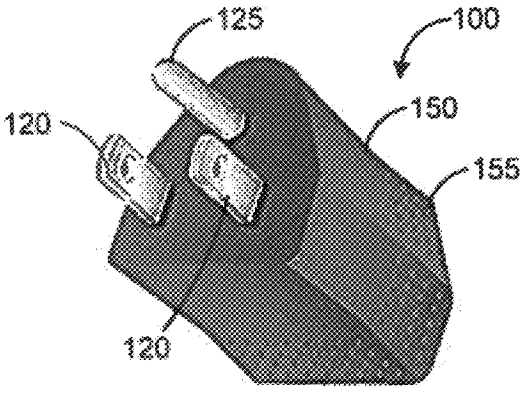

Referring first to FIGS. 1A to 1C, depicted are drawings of the rear, front and side perspective views, respectively, of a plug-in antenna module 100 according to one embodiment. The plug-in antenna module 100 comprises a rear portion 105, a front portion 110 and a body portion 115 located between the rear portion 105 and front portion 110. The rear portion 105 of the plug-in antenna module 100, as shown in FIG. 1A, is adapted for insertion to a standard electrical receptacle. For example, in the embodiment shown, the rear portion 105 is configured as a North American three-pronged NEMA 5-15 plug (Type "B") comprising two flat parallel blades 120 for the live and neutral electrical conductors and a dedicated ground (Earth) connector 125.

Figure 2C:
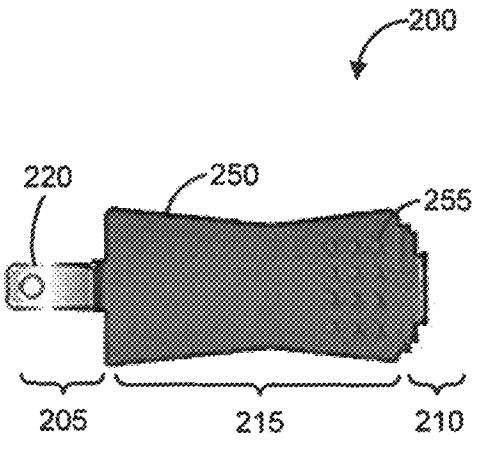
FIGS. 2A to 2C (collectively, FIG. 2) are rear, front and side perspective views of a plug-in antenna module according to another embodiment of the invention.
Figure 2B:
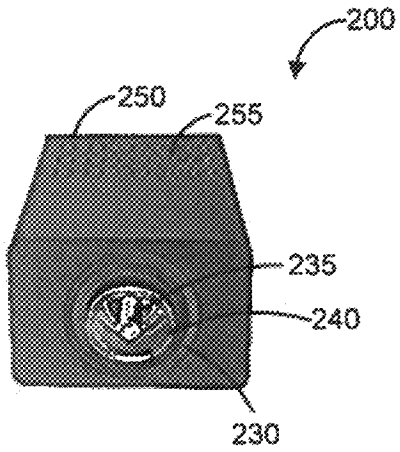
Figure 2A:
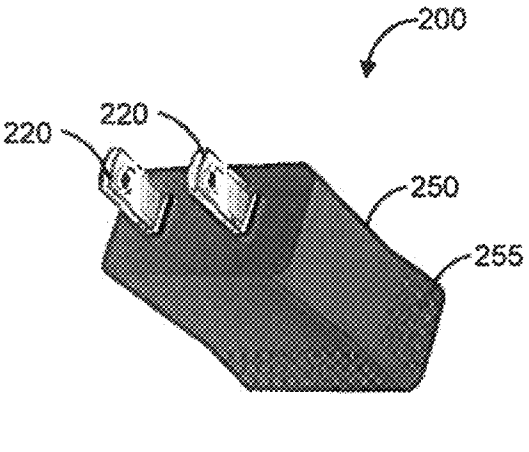

FIGS. 2A to 2C depict, respectively, the rear, front and side perspective views of plug-in antenna module 200 according to another embodiment which is a variation of plug-in antenna module 100. The plug-in antenna module 200 includes a rear portion 205, a front portion 210 and a body portion 215 that separates the rear portion 205 and front portion 210. The rear portion 205 of the plug-in antenna module 200 is configured as a North American NEMA 1-15 plug (Type "A) comprising two flat parallel blades 220 for the live and neutral electrical conductors (no ground connector). Other embodiments of the invention may incorporate other plug configurations corresponding with the configurations of other types of electrical receptacles in North America and elsewhere in the world in which the plug-in antenna module may be used. For example, alternate plug configurations may include the 15 types of electrical outlet plugs, Types A through O, as identified by the US Department of Commerce International Trade Administration (ITA).

The respective front portion 110, 210 of the plug-in antenna module 100, 200, as shown in FIGS. 1B and 2B, comprises a coaxial connector 130, 230 for providing a communication signal to the signal receiver. The signal can be sent to the signal receiver using coaxial cabling. In embodiments where the signal receiver comprises a television set, the communication signal comprises television signals corresponding to one or more television channels captured by the electrical wiring. Each coaxial connector 130, 230 includes a signal conductor 135, 235, and a signal reference 140, 240.

In the case of television broadcasts, receivers such as television sets generally include a coaxial input port to receive a television signal, for example, from an antenna or from a set-top-box operable to decode cable, satellite or IP (Internet Protocol) television signals. The coaxial input port is often a type-F coaxial RF connector with a 75 Ohm characteristic impedance. However, other connector types may be used including, but not limited to, BNC, TNC, SMA and RCA connectors. Front portion 110, 210 of the plug-in antenna module 100, 200 can be configured to provide a compatible or matching coaxial connector 130, 230 to transfer the captured communication signal to the receiver. Alternatively, where the coaxial connector 130 and 230 is incompatible with the connector type of the receiver input, adaptors may be used to convert the coaxial connector 130 and 230 from one type of connector to another type of connector (e.g. from BNC to type-F).

The front portion 110 and 210 of the plug-in antenna module 100 and 200, as shown in FIGS. 1B and 2B depicts a male F-type coaxial connector. Use of a male coaxial connector configuration may be suitable for attaching the plug-in antenna module 100 and 200 to a signal amplifier (not shown) to improve the quality of the received signal. Such amplifiers often include a female coaxial connector at its input port. In other embodiments, front portion 110, 210 may be configured with a female coaxial connector 130, 230 for mating with a male coaxial connector positioned at a first end of a coaxial cable (e.g. the end proximal to the module 100, 200), while the second end of the coaxial cable (e.g. the end distal from the module 100, 200) can be connected to a signal input port of a receiver such as a television.

Figure 6C:
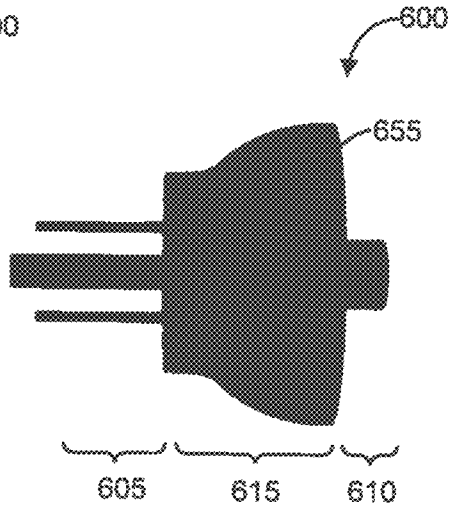
FIGS. 6A to 6C (collectively, FIG. 6) are rear, front and side perspective views of a plug-in antenna module according to another embodiment of the invention.
Figure 6B:
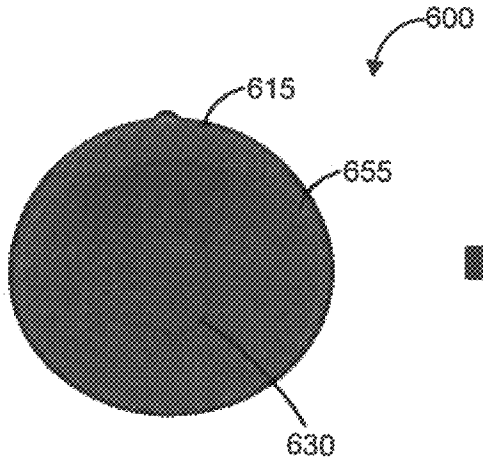
Figure 6A:
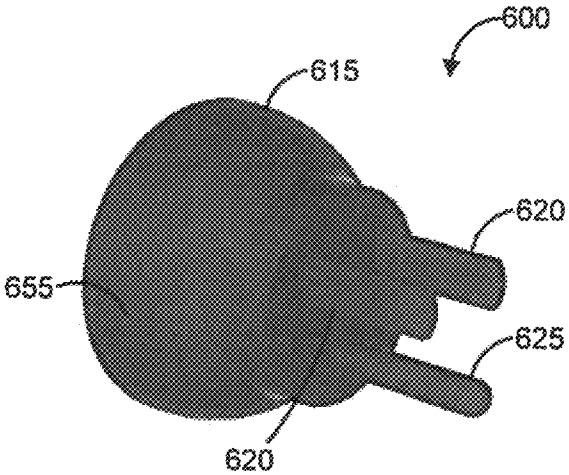

Plug-in antenna module 100, 200 comprises a main body 150, 250 which gives the module physical structure to facilitate insertion into and removal from an electrical receptacle. For example, is the main body 150, 250 may be shaped to enable gripping of the module between a user's fingers. In the embodiments shown in FIGS. 1 and 2, the main body 150, 250 is further provided with a plurality of miniature bumps 155, 255 to improve gripping. In other embodiments, the surface of the main body 150, 250 may be free of bumps. Instead, the surface of the main body 150, 250 may be finished with a texture to facilitate gripping. In yet other embodiments, the surface may be free of bumps or textures such that the surface of the body 150, 250 is smooth. The main body 150, 250 can be made of various suitable materials such as plastic or ceramic or other insulating materials to reduce the risk of electrical shock. Furthermore, the main body can be made to conform to a desired shape. In the configuration of FIGS. 1A to 1C, the body is shaped to resemble a triangular prism. Other shapes can be selected for more ergonomic or space-saving configurations. For Example, FIGS. 6A to 6C is shaped to resemble a truncated hemisphere, for improved gripping.

Figure 3:
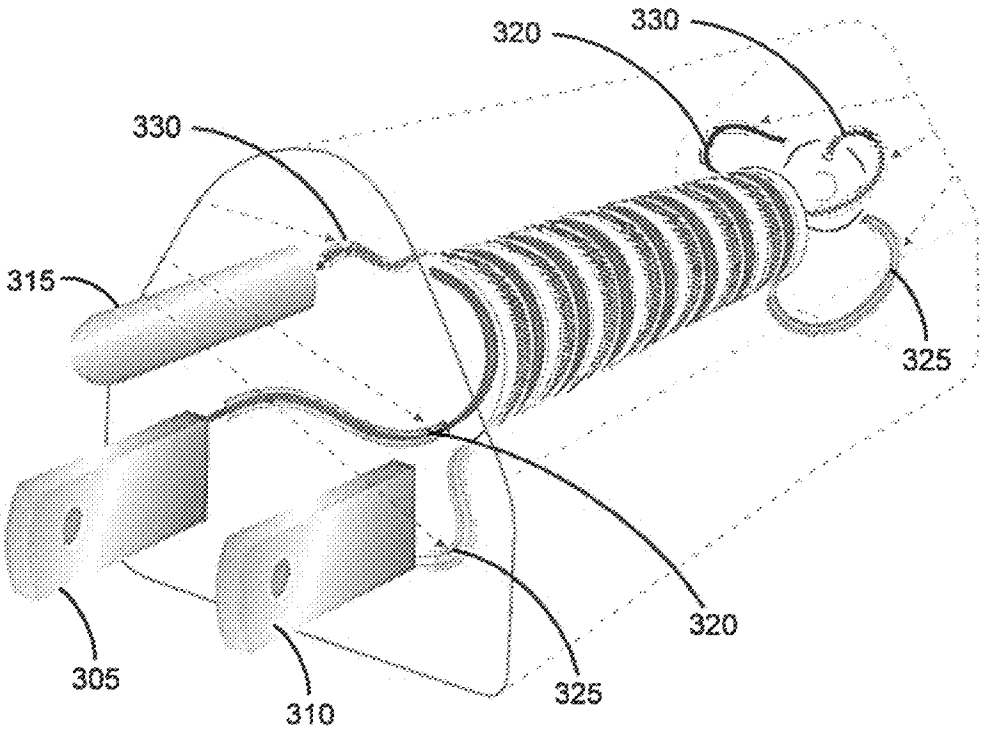
FIG. 3 is a rear perspective cut-away view of the plug-in antenna module of FIG. 1.

FIG. 3 is a rear perspective cut-away view of plug-in antenna module 100 of FIG. 1 showing the module's internal structure. As noted previously, the rear portion 105 is configured to provide a 3-pronged connector. In the illustrated embodiment, the 3-pronged connector comprises a first electrical connector 305, second electrical connector 310 and a ground pin 315. Upon insertion of the module 100 into a corresponding electrical receptacle, the first and second electrical connectors 305, 310 connect to the live and neutral AC (alternating current) wires of the electrical system of a building (one of the electrical connectors 305, 310 connects to the live wire while the other one of the electrical connectors 305, 310 connects to the neutral wire). The ground pin 315 connects to the grounding wires of the electrical system of the building.

Each of the electrical connectors 305, 310 and the ground pin 315 is connected to an electrical conducting wire provided within the body portion 115. In the embodiment shown, a first conducting wire 320, a second conducting wire 325 and a ground wire 330 (collectively the "conducting wires") are electrically connected to the first connector 305, second connector 310 and ground pin 315, respectively, at the rear end 105. Through this arrangement the conducting wires are in electrical contact with the current-carrying electrical lines of the building.

Within the body portion 115 of the plug-in antenna module 100, the first and second conductors 320, 325 are wound together helically around the ground wire 330. The ground wire 330 may act as a core for the winding. The winding can be arranged so that the first and second conducting wires 320, 325 are wound around the core in a non-overlapping manner as shown. In other embodiments, the first and second conducting wires 320, 325 are intertwined so that these conductors overlap each other in the winding.

In one embodiment, the core may be set to a predetermined length to obtain the desired inductive coupling from the first and second conducting wires 320, 325 to the core. For example, the length can be set to 20 cm for a given winding density (e.g. the number of turns per unit length). However, other lengths may be suitable depending on the size limitation of the main body and desired winding density. Any suitable method of wrapping the first and second conducting wires 320,325 around the core can be used to obtain the desired number of turns and the shape of the winding coil. In some embodiments, the winding along with the core can be folded together so as to enable the winding to be more compact.

In a preferred embodiment, the conducting wires are made of low resistance material such as silver, copper or gold. The conducting wires are insulated to avoid creation of a short circuit as a result of transfer of electrical current between the conducting wires and/or between the conducting wires and the coaxial connector. Such short circuits would likely damage the receiver. The insulation can be provided by coating each conducting wire with a suitable insulating material such as plastic, ceramic or rubber. In a particular embodiment, polyvinyl chloride (PVC) is used is used as the insulating material. In some embodiments, the material used for the core may be a ferromagnetic material such as iron to increase the inductance of the winding. The increased inductance can provide enhanced inductive coupling between the winding and the core. It can reduce the number of windings needed or the length of the core needed to obtain the same level of inductance and/or inductive coupling relative to a core that is not ferromagnetic. As such, using a ferromagnetic core can reduce the overall size and bulkiness of the module.

The conducting wires extend, within the body portion 115, from the rear portion 105 to the front portion 110 proximal to the coaxial connector 130. At the front portion 110, the first and second conducting wires 320 and 325 are left unterminated (e.g. floating in an "open circuit" configuration). In some embodiments, the ground wire 330 is in close proximity to signal conductor 135 of the coaxial connector 130 shown in FIG. 1B. In preferred embodiments, the ground wire 330 is in electrical contact with the signal conductor 135. The unterminated first and second conductors 320 and 325 further prevent electrical current of the building's electrical system from reaching the coaxial connector.

Figure 4:
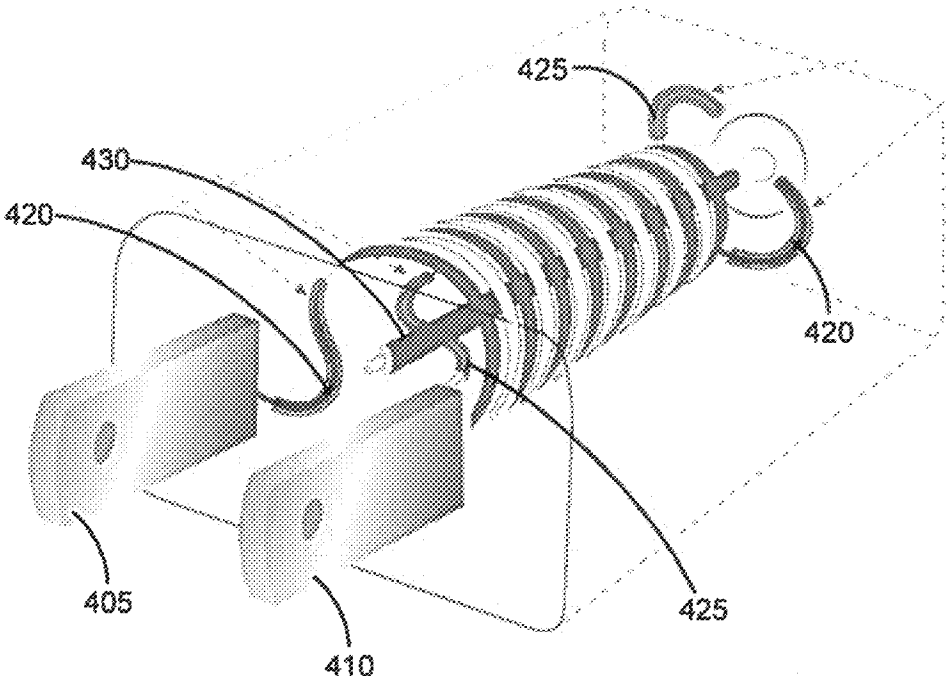
FIG. 4 is a rear perspective cut-away view of the plug-in antenna module of FIG. 2.

FIG. 4 is a rear perspective cut-away view of plug-in antenna module 200 of FIG. 2 showing the two-pronged module's internal structure. Structures similar to those in FIG. 3 are identified herein using similarly formatted reference numerals. In the present embodiment, the rear portion 205 is configured to provide a 2-pronged connector 220 with a first electrical connector 405 and second electrical connector 410. Upon insertion of the module 200 into an electrical receptacle, the first and second electrical connectors 405, 410 connect to the live and neutral wires of the AC electrical system of a building (one of the connectors 405, 410 connects to the live wire while the other one of the connectors 405, 410 connects to the neutral wire).

Each of the electrical connectors 405, 410 is connected to an electrical conducting wire provided within the body portion 215. In the embodiment shown, a first conducting wire 420 and a second conducting wire 425 are electrically connected to the first connector 405 and second connector 410, respectively, at the rear end 205. Within the body portion 215 of the plug-in antenna module 200, the first and second conductors 420, 425 are wound together helically around a third conducting wire 430 (these wires are collectively referred to as the "conducting wires"). The third conducting wire 430 may act as a core for the winding.

Similar to the FIG. 3 embodiment, the winding in the plug-in antenna module 200 of FIG. 4 can be arranged so that first and second conductors 420, 425 are wound around the core 430 in a non-overlapping manner. In other embodiments, the first and second conducting wires 420, 425 are intertwined so that the conductors overlap each other in the winding. Similar to the FIG. 3 embodiment, the conducting wires of the plug-in antenna module 200 of FIG. 4 are also insulated to avoid creation of a short circuit that could damage the receiver as a result of transfer of electrical current between the conducting wires and/or between the conducting wires and the coaxial connector. The use of a ferromagnetic material for the core, and/or different coil winding techniques, as described previously, may also be employed.

Also similar to the FIG. 3 embodiment, the conducting wires of the plug-in antenna module 200 of FIG. 4 extend, within the body portion 215, to the front portion 210 proximal to the coaxial connector 230. At the front portion 210, the first and second conductors 420 and 425 are unterminated. The third conductor 330 is preferably in electrical contact with the signal conductor 235 of the coaxial connector 230 of FIG. 2B. The unterminated first and second conductors 320 and 325 further prevent electrical current of the building's electrical system from reaching the coaxial connector.

It may be understood that the above-described configurations of the 2- and 3-pronged plug-in antenna modules 100 and 200 enable the safe use of the electrical wiring of at least a portion of a building's AC electrical system as an antenna to capture electromagnetic waves corresponding to communication signals. In each configuration, windings of the first and second conducting wires 320, 325, and 420, 425 operate to inductively transfer the captured communication signal to the ground wire 330 or third conducting wire 430 for output via the signal conductor 135, 235 of coaxial connector 130, 230. The winding can be considered to function as a balun operable to convert a balanced connection, generally used for connecting to an antenna, to an unbalanced connection such as a coaxial line, for connection to an amplifier or a receiver.

The plug-in antenna modules 100 and 200 can incorporate additional safety features to further reduce or eliminate the risk of shock. For example a fuse system, diode system or a fuse and diode (e.g. a clamp/suppression diode) combination system mounted on a printed circuit board (not shown) may be provided within the body portions 115 and 215. These systems can be used to minimize or eliminate sudden voltage or current spikes from reaching the coaxial connector or a person handling the modules.

Figure 5:
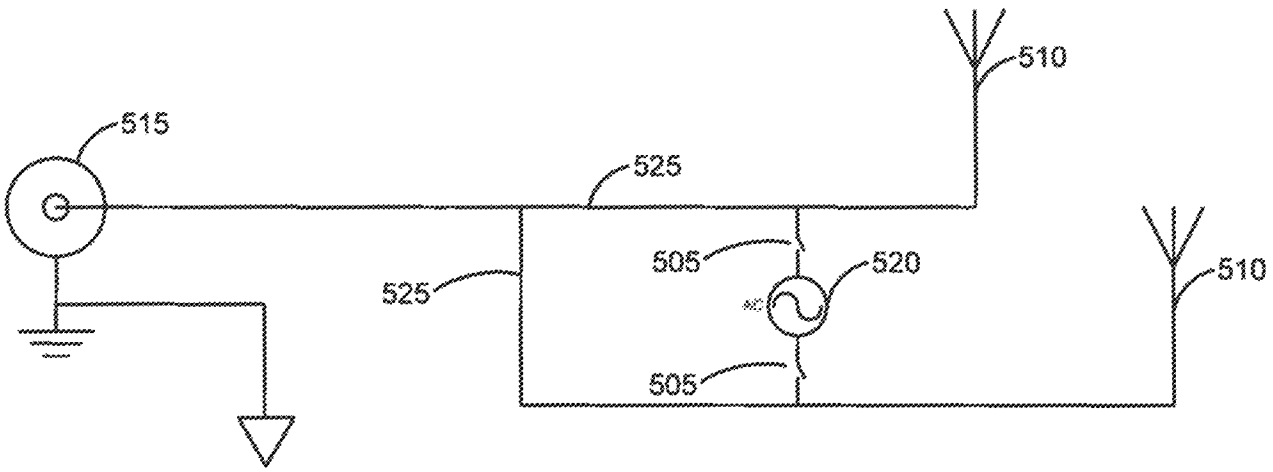
FIG. 5 is a schematic diagram of an equivalent circuit of the electrical structures of the plug-in antenna modules of FIGS. 3 and 4.

FIG. 5 shows an equivalent circuit diagram corresponding to the internal structure of the plug-in antenna module 100 and 200. In the present embodiment, AC source 520 includes live and neutral power delivery lines that are electrically separated from the rest of the plug-in antenna module 100 and 200 by the use of insulated conducting wires as described above. This electrical separation is represented in the equivalent circuit diagram using circuit breakers 505 that impede AC power from reaching the coaxial connector 515. Inductive coupling (e.g. via the above-described winding) of the antenna elements 510 of the electrical system and the coaxial connector 515 (comprising connector 130, 230 of the FIGS. 1, 2 embodiments) is provided and may be represented in FIG. 5 by way of signal paths 525 between the antenna elements 510 and the coaxial connector 515. This manner of coupling therefore permits delivery of the communication signal to a receiver, by way of the coaxial connector 515, while preventing transfer of electrical current from the AC source 520 of the electrical system to the receiver.

FIGS. 6A to 6C show another embodiment in which only the ground connector is utilized to provide a signal transmission path to the coaxial connector. These figures illustrate the rear, front and side perspective views, respectively, of plugin-in antenna module 600. The plug-in antenna module 600 comprises a rear portion 605, a front portion 610 and a body portion 615 located between the rear portion 605 and front portion 610. The body portion includes, on its surface, a texture 655 to facilitate ease of gripping. The rear portion 605 of the plug-in antenna module 600, as shown in FIG. 6A, is adapted for insertion to a standard electrical receptacle as previously described. In the present example, the rear portion 605 is configured as a North American three-pronged NEMA 5-15 plug (Type "B") comprising two flat parallel blades 620 for the live and neutral electrical conductors and a dedicated ground (Earth) connector 625. The front portion 610 comprises a coaxial connector 630 for providing a communication signal to the signal receiver via coaxial cabling as previously described.

In the present embodiment, however, the two flat parallel blades 620 intended for insertion into the live and neutral receptacles are fabricated of an insulating material. For example, the blades 620 can be made of the same material as the body portion 615, or another suitable rigid yet electrically insulating material to provide structural support for the plug-in antenna module 600 when it is inserted into an electrical socket. The blades 620 can be produced using techniques known to those in the art, such as injection molding and the like. In this configuration, only the ground connector 625 is conductive to provide a signal path to the coaxial connector 630.

Figure 7:
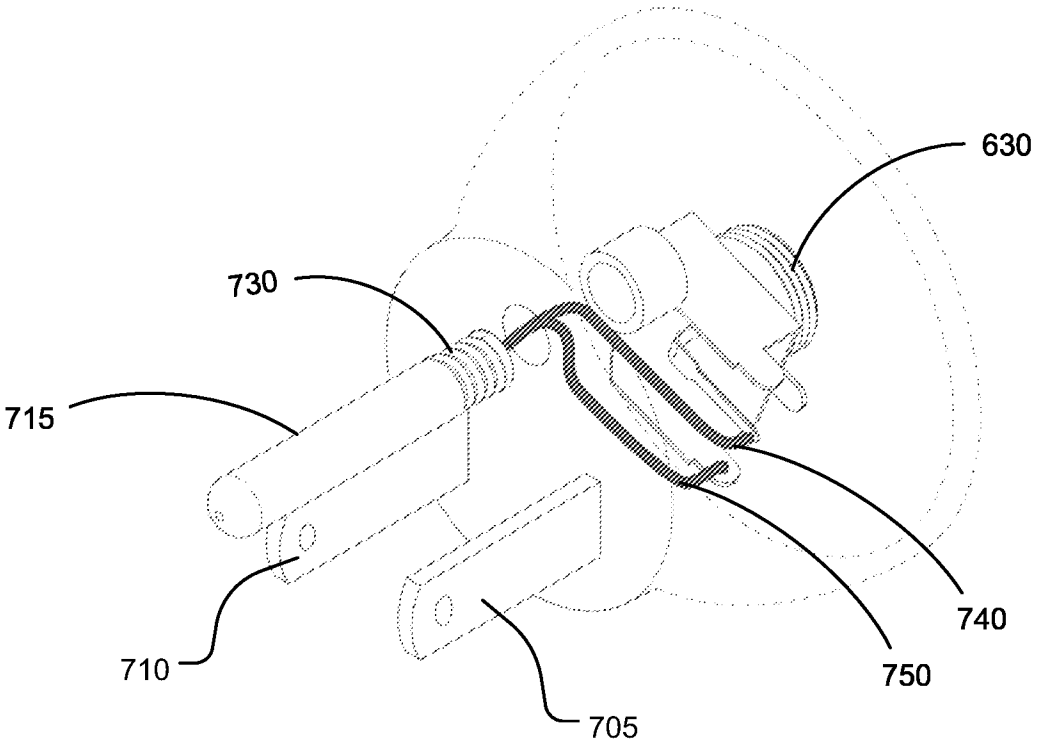
FIG. 7 is a cut-away view of the plug-in antenna module of FIG. 6.

FIG. 7 is a cut-away view of the plug-in antenna module 600 of FIG. 6 showing the module's internal structure. In the illustrated embodiment, the 3-pronged connector comprises a first insulated connector 705, a second insulated connector 710 and a conductive ground pin 715. Also shown in the figure is a ground wire 730 that provides a conductive path between the ground connector 715 and the coaxial connector 630. Accordingly, upon insertion of the module 600 into an electrical receptacle, the ground pin 715 provides the coaxial connector with a connection to the grounding wires of the electrical system of the building via ground wire 730.

The ground wire 730 illustrated in FIG. 7 comprises a pair of intertwined coiled first and second conductors 740 and 750. Each of the conductor pair is connected to the coaxial connector 630 at one end. At the other end, one of the conductors is connected to the ground pin 715, the other conductor remains floating (i.e. open-circuit). While two conductors are used in the present embodiment, a single conductor connecting the coaxial connector 630 and ground pin 715 can similarly be used. The ground wire 730 as shown in FIG. 7 is coiled to provide the desired filtering characteristics to obtain a suitable frequency response for the intended use of the module 600. For example, where the plug-in antenna module 600 is used as an adaptor for receiving television broadcasts such as high definition television (HDTV) broadcasts (although reception of analogue broadcasts may also be possible), the coiled ground wire 730 may be wound to provide approximately ⅜ inch (9.525 mm) diameter (or any other suitable diameter) per turn of the coil and having a minimum of 12 turns (or any other suitable number of turns) to obtain the desired frequency filtering to exclude frequencies that fall outside the frequency range associated with television broadcasts. In some implementations, the intertwined first and second conductors 740 and 750 are wound using the same winding configuration (i.e. ⅜ inch or 9.525 mm diameter having a minimum of 12 turns each). In other implementations, each conductor may be wound using different winding parameters.

In the two-conductor configuration shown in FIG. 7, each conductor can be coiled in the same manner (i.e. having the same diameter and number of turns). Alternatively, in other embodiments, the number of turns or the diameter, or both the number of turns and the diameter can vary between the two conductors.

In some cases, there may be a desire to configure the plug-in antenna module to provide both access to AC power and access to a captured communication signal. Since the plug-in antenna module is intended to be inserted into an electrical receptacle, its use would result in the reduction of the number of available electrical receptacles available for providing AC power. The reduction of available electrical receptacles may be an inconvenience, especially if the number of receptacles in a room is low. Accordingly, in some embodiments, the described plug-in antenna module can be modified to provide a power "pass-through" component that permits transfer of both AC power as well as the communication signals from the rear end to the front end. For example, the front end 110, 210 of the plug-in antenna module 100, 200 can be modified to include both a coaxial connector 130, 230 as well as an electrical receptacle for receiving the electrical plug of an electrical device or appliance. In this embodiment, the first and second conducting wires 320, 325 of FIG. 3 and 420, 425 of FIG. 4 can be connected to the electrical receptacle rather than being left unterminated. Similarly, the ground wire 330 (if present) can connect to a corresponding ground receptacle at the front end 110, 210 (if present).

In some embodiments, the plug-in module can be used to convert a three-pronged receptacle to a two-pronged receptacle. For example, the rear end may be configured to resemble the plug-in module 100 of FIG. 1A comprising three prongs. The receptacle at the front end, however, may be two pronged. In other embodiments, the plug at the rear end corresponds to the receptacle at the front end (i.e. they are mateable). In yet other embodiments, the plug-in module can be used as an electrical plug adaptor, for example, for travelers. For instance, the rear end may be configured to mate with a receptacle used in one jurisdiction such as North America, while the front end may be configured to provide a receptacle used in another jurisdiction such as Europe. In this example, the plug-in antenna module would permit devices with European-compliant plugs to draw power from otherwise incompatible North American receptacles.

In some embodiments, the front portion is equipped with one or more Universal Serial Bus (USB) power receptacle(s) (in addition to the coaxial connector) instead of an electrical receptacle. In such embodiments, a power conditioning unit operable to convert AC voltage to DC (direct current) voltage compliant with the USB specification is included within the main body. Specifically, the current-carrying conducting wires carrying AC power inside the main body which form the winding described previously are connected to an input of the power conditioning unit instead of remaining unterminated. The output of the power conditioning unit is connected to the USB receptacle(s) at the front portion. Such a feature would be useful for charging battery powered devices such as mobile phones, smartphones and tablet devices. In some embodiments, cooling elements may be incorporated to avoid overheating of the power conditioning unit.

In some embodiments, a further antenna may be incorporated to the plug-in module 100, 200 to increase range and enhance signal reception. Such an antenna may comprise a conventional antenna such as a "rabbit-ear" or a "bow-tie" antenna or another type of antenna. The antenna may be coupled to the device via the coaxial connector 130, 230.

The examples and corresponding diagrams used herein are for illustrative purposes only. Different configurations and terminology can be used without departing from the principles expressed herein.

Although the invention has been described with reference to certain specific embodiments, various modifications thereof will be apparent to those skilled in the art without departing from the scope of the invention. The scope of the claims should not be limited by the illustrative embodiments set forth in the examples, but should be given the broadest interpretation consistent with the description as a whole.

The invention claimed is:

1. An apparatus for adapting at least a portion of a building's electrical wiring system as an antenna for receiving a radio frequency signal comprising a communication signal, the apparatus comprising:

(a) a plug portion comprising first and second prongs for insertion into an electrical receptacle in the building to connect the apparatus to the building's electrical wiring system;

(b) a coaxial connection portion comprising a coaxial connector for providing the communication signal captured by the antenna to a signal receiver; and (c) a body portion between the plug portion and the coaxial connection portion, the body portion comprising a plurality of conducting wires extending from the plug portion to the coaxial connection portion, the conducting wires comprising first and second wires in respective electrical contact with first and second prongs, and a third wire in electrical contact with or close proximity to the coaxial connector, wherein the first and second wires are electrically insulated from each other and from the third wire, wherein the first and second wires are wound around the third wire to inductively transfer the communication signal captured by the antenna to the third wire for output to the signal receiver via the coaxial connector, and wherein the first and second wires are unterminated at the coaxial connection portion and are not physically connectable to the third wire.

2. The apparatus of claim 1 wherein the first and second prongs are respectively for connecting to live and neutral alternating current (AC) wires of the building's electrical wiring system.

3. The apparatus of claim 2 wherein the plug portion comprises a ground pin for connecting to a dedicated ground pathway for the building's electrical wiring system, and wherein the third wire connects to the ground pin.

4. The apparatus of claim 1 wherein the third wire serves as a core for the wound first and second wires.

5. The apparatus of claim 1 wherein the first and second wires are electrically insulated from each other and from the third wire by sheathing the first and second wires in an insulating material.

6. The apparatus of claim 5 wherein the insulating material is polyvinyl chloride.

7. The apparatus of claim 1 wherein the conducting wires comprise a material with low resistivity.

8. The apparatus of claim 1 wherein the first and second wires form a helical coil around the third wire.

9. The apparatus of claim 1 wherein the radio frequency signal comprises radio or over-the-air television signal.

10. The apparatus of claim 1 wherein the coaxial connector of the coaxial connection portion is adapted to matingly engage with a corresponding coaxial connector provided on a signal amplifier.

11. The apparatus of claim 1 wherein a housing of the apparatus comprises a bumpy and/or textured surface to enable a user to more securely grip the apparatus.

12. A plug-in apparatus for delivering a radio or television signal to a receiver, the apparatus comprising:

(a) a rear portion comprising a plug for insertion into a corresponding electrical receptacle in a building to connect the plug-in apparatus to the building's electrical wiring system;

(b) a front portion comprising a coaxial connector; and (c) a winding extending between the plug and the coaxial connector, the winding comprising a plurality of conducting wires wrapped around a core, wherein first and second conducting wires are sheathed in electrically insulating material and respectively connected to live and neutral AC wires of the building's electrical system when the plug is inserted into the electrical receptacle, wherein the core is in contact with the coaxial connector, and wherein the first and second wires are unterminated at the front portion and physically not connectable to the coaxial connector.

13. A method for adapting at least a portion of a building's electrical wiring system as an antenna for receiving a radio frequency signal comprising a communication signal, the method comprising: (a) providing a plug comprising connector prongs for insertion into a corresponding electrical receptacle in a building to connect to the building's electrical wiring system; (b) providing a coaxial connector; (c) providing first, second and third conducting wires extending between the plug and the coaxial connector, wherein first and second conducting wires are wound around the third conducting wire, wherein the first and second conducting wires are unterminated and are sheathed in electrically insulating material to prevent passage of AC to each other and to the third conducting wire, and wherein the first and second conducting wires are not physically connectable to the third conducting wire; and (d) connecting the first and second conducting wires to live and neutral AC wires respectively of the building's electrical system via the connector prongs of the plug, and connecting the third conducting wire with the coaxial connector, so that the first and second conducting wires inductively transfer the radio frequency signal captured by the building's electrical wiring system to the coaxial connector while preventing electrical current of the building's electrical system from reaching the coaxial connector.

14. The method of claim 13 wherein the plug comprises a ground pin, and the method comprises connecting the third conducting wire to the ground pin.

15. The method of claim 13 comprising winding the first and second conducting wires to form a helical coil around the third conducting wire.

16. The apparatus of claim 5 wherein the insulating material is plastic, ceramic or rubber.

17. The apparatus of claim 7 where the material with low resistivity is silver, copper or gold.

* * * * *